United States Patent [19]

Ichida et al.

[11] Patent Number: 4,922,166

[45] Date of Patent: May 1, 1990

[54] ELECTRON GUN FOR MULTIGUN CATHODE RAY TUBE

[75] Inventors: Koji Ichida; Yoshifumi Nakayama; Hiromu Inoue, all of Tokyo, Japan

[73] Assignee: Sony Corporation, Tokyo, Japan

[21] Appl. No.: 338,372

[22] Filed: Apr. 12, 1989

Related U.S. Application Data

[63] Continuation of Ser. No. 67,979, Jun. 30, 1987, abandoned.

[30] Foreign Application Priority Data

Jun. 30, 1986 [JP] Japan ..... 61-153312
Jun. 30, 1986 [JP] Japan ..... 61-153313
Jun. 30, 1986 [JP] Japan ..... 61-153314

[51] Int. Cl.[5] ..... H01J 29/51

[52] U.S. Cl. ..... 313/414; 313/412; 315/382

[58] Field of Search ..... 313/409, 412, 414, 432, 313/439, 449, 458; 315/14, 15, 16, 382

[56] References Cited

U.S. PATENT DOCUMENTS 3,619,686 11/1971 Miyaoka ..... 313/412
4,119,883 10/1978 Miyaoka ..... 313/414
4,230,972 10/1980 Bafaro ..... 315/382
4,528,476 7/1985 Alig ..... 313/409
4,701,678 10/1987 Blacker et al. ..... 313/412
4,704,565 11/1987 Blacker, Jr. et al. ..... 313/412 X

FOREIGN PATENT DOCUMENTS 0013041 7/1980 European Pat. Off. .
1966566 1/1983 Fed. Rep. of Germany ..... 313/409
19755 2/1980 Japan .
1258337 12/1971 United Kingdom .
1279524 6/1972 United Kingdom .
1289419 9/1972 United Kingdom .
2112564 7/1983 United Kingdom .

*Primary Examiner*—Donald J. Yusko
*Assistant Examiner*—Michael Horabik
*Attorney, Agent, or Firm*—Hill, Van Santen, Steadman & Simpson

[57] ABSTRACT

An electron gun arrangement for color cathode-ray tubes comprising three cathodes for emitting electron beams, for example, for red, green and blue, and a main electron lens comprising three front electron lenses corresponding to the cathodes, respectively, and a back electron lens common to all the cathodes. Each front electron lens is formed with an aperture smaller than that of the back electron lens and is mounted so as to meet Fraunhofer conditions so that aberration is reduced. Electron beam transmitting apertures are formed in the grids forming the front electron lenses, respectively, with the respective center axes thereof parallel to each other, which makes it easy to manufacture the electron gun arrangement and enables accurate machining during manufacturing.

3 Claims, 20 Drawing Sheets

ELECTRON GUN FOR MULTIGUN CATHODE RAY TUBE

This is a continuation of application Ser. No. 067,979, filed June 30, 1987 now abandoned.

BACKGROUND OF THE INVENTION

1. Field of the Invention

The present invention relates to an electron gun arrangement suitable for use in a cathode-ray tube such as, for example, a picture tube for receiving color television.

2. Description of the Prior Art

FIG. 6 shows a conventional multibeam single electron gun arrangement, by way of example, for use in a color television receiving tube. This electron gun arrangement has cathodes $K_R$, $K_G$ and $K_B$ corresponding to electron beams for red, green and blue, respectively. A first grid $G_1$, a second grid $G_2$, a third grid $G_3$, a fourth grid $G_4$ and a fifth grid $G_5$ are arranged commonly for the cathodes K ($K_R$, $K_G$ and $K_B$). The cathodes K and the first to third grids $G_1$ to $G_3$ form a cathode prefocusing lens, while the grids $G_3$ to $G_5$ form a unipotential main electron lens. In this conventional electron gun arrangement, the electron beams respectively emitted from the cathodes $K_R$, $K_G$ and $K_B$ intersect each other at a position substantially in the central portion of the main electron lens meeting the Fraunhofer conditions, namely, at a position which provides conditions to eliminate coma aberration. A converging means C such as, for example, electrostatic deflecting plates, is provided after the fifth grid $G_5$ to converge the electron beams $B_R$, $B_G$ and $B_B$ emitted from the cathodes $K_R$, $K_G$ and $K_B$, respectively, on a fluorescent screen, not shown. In such a conventional electron gun arrangement, since the main electron lens exerts an effect in common on all the electron beams, the aperture of the main electron lens can be increased within a limited area of the neck section of the cathode-ray tube to reduce aberration.

On the other hand, in such a cathode-ray tube, focusing conditions are decided so that the electron beams respectively emitted from the cathodes $K_R$, $K_G$ and $K_B$ are focused on the fluorescent screen at optimum spots. Concretely, an optimum focusing voltage $V_F$ is applied to a focusing electrode, for example, the fourth grid $G_4$ of the main electron lens of the electron gun arrangement of FIG. 6. However, the focusing conditions are different between the central portion and peripheral portion of the fluorescent screen because of the difference between the central portion and the peripheral portion have different distances from the main electron lens. Accordingly, it is a general practice to apply a dynamic focusing voltage synchronized with the horizontal and vertical deflection of the electron beams on the fluorescent screen to the focusing electrode in addition to a fixed focusing voltage $V_F$ so that the electron beams are focused satisfactorily over the entire area of the fluorescent screen.

In an electron gun arrangement developed through the improvement of the electron gun arrangement of FIG. 6 in respect to aberration, a focusing voltage is applied to an electrode serving for both the electrode of the main electron lens and the electrode for the cathode prefocusing lens. In this improved electron gun arrangement, when a dynamic focusing voltage is applied in addition to a fixed focusing voltage $V_F$ to the cathode prefocusing lens, the cathode current varies to cause irregular brightness distribution on the fluorescent screen making the peripheral portion of the fluorescent screen brighter than the central portion.

As mentioned above, in the electron gun arrangement of FIG. 6, aberration is reduced by increasing the aperture of the main electron lens. However, the beam spot is liable to bloom due to increase in spherical aberration when the beam current is large. In the electron gun arrangement of FIG. 6, the effect of the focusing voltage for sharply focusing the electron beams at the same position on the fluorescent screen is different for the center beam $B_G$ traveling coaxially with the axis of the main electron lens L, and the side beams $B_R$ and $B_B$ traveling obliquely to the axis of the main electron lens L. That is, when the focusing voltage $V_F$ is appropriate for sharply focusing the side beams $B_R$ and $B_B$, the center beam $B_G$ is focused at a position before the fluorescent screen and, when the focusing voltage $V_F$ is appropriate for sharply focusing the center beam $B_G$, the side beams $B_R$ and $B_B$ are focused at a position beyond the fluorescent screen. Such a problem can be solved by disposing the central cathode $K_G$ for emitting the center electron beam away from the main electron lens L relative to the side cathodes $K_R$ and $K_B$ for emitting the side electron beams, as illustrated in FIG. 7. In the configuration shown in FIG. 7, since the second grid $G_2$ and the successive grids are common to all the electron beams, a portion of the second grid $G_2$ facing the first grid $G_{1G}$ corresponding to the central cathode $K_G$ extends backwardly so that the respective gaps between the second grid $G_2$ and the first grids $G_{1R}$, $G_{1G}$ and $G_{1B}$ respectively corresponding to the cathodes $K_R$, $K_G$ and $K_B$ are substantially the same to cause the effect of the main electron lens on all the electron beams to be the same. However, the equipotential surfaces relating to the central beam $B_G$ are curved as indicated by lines a in FIG. 7, and the curved equipotential surfaces exert an additional focusing effect on the central beam $B_G$. Consequently, the crossover point of the central beam is varied, the substantial object point of the electron lens system relating to the central beam is moved and, in some cases, the spot of the central beam is distorted. Such inconveniences may be avoided by curving the rear end of the third grid $G_3$ facing the front end of the second grid $G_2$ along the front end of the second grid $G_2$ and by decreasing the gap between the second grid $G_2$ and the third grid $G_3$ so that the equipotential surfaces are parallel to each other. However, since a high voltage V is applied to the third grid $G_3$, electrical discharges occur between the second grid $G_2$ and the third grid $G_3$ when the gap between the second grid $G_2$ and the third grid $G_3$ is too small.

Referring to FIG. 8 showing another unipotential electron lens system, a high voltage $V_A$ is applied to the third grid $G_3$ and the fifth grid $G_5$ of the main electron lens, and a focusing voltage $V_F$ is applied to the fourth grid $G_4$ of the main electron lens. Ordinarily, in the unipotential electron lens system of this type, the grids $G_3$ and $G_5$ to which the high voltage $V_A$ is applied and the grid $G_4$ to which the focusing voltage $V_F$ is applied are substantially the same in diameter, or as shown in FIG. 9, the respective ends of the high-voltage grids $G_3$ and $G_5$ facing the focusing grid $G_4$ are reduced in diameter to shield the path of electron beams from disturbance caused by an external electric field. In either case, the focusing grid $G_4$ is formed so as to meet a condition:

$l/D=0.5$ to 2.0, where l is the length and D is the diameter of the grid $G_4$.

FIG. 10 shows the calculated spherical aberration characteristics of the unipotential electron lens system comprising the grids $G_3$ to $G_5$ having the same diameter (FIG. 8) for various values of $l/D=\psi$, in which the ratio *$f/D=\zeta$(f=focal length, D=aperture) is measured on the X-axis and the coefficient Cs of spherical aberration is measured on the Y-axis. As is obvious from FIG. 10, when the ratio $\zeta$ is fixed, the coefficient Cs of, spherical aberration diminishes as the ratio $\gamma$ is increased. Particularly, since the value of the aperture D is limited by the diameter of the neck section of the cathode-ray tube, when the focal length f is fixed, the longer the length of the grid $G_4$*, the smaller the spherical aberration. However, since the aberration is saturated when the ratio $\gamma$ is 2.0 or greater, it is desirable to reduce the focal length f when the ratio $\gamma$ is fixed. Nevertheless, in general, when the length l of the grid $G_4$ is increased, namely, when the ratio $\gamma$ is large, the focal length f cannot be diminished. This problem will be described in detail with reference to FIG. 11. In a unipotential electron lens system, suppose that lenses 1 and 2 are formed between a third grid $G_3$ and a fourth grid $G_4$ and between the fourth grid $G_4$ and the fifth grid $G_5$, respectively, $f_1$ and $f_2$ are the respective object focal lengths of the lenses 1 and 2, $F_1$ and $F_2$ are the respective image focal lengths of the lenses 1 and 2, $F_1'$ and $F_2'$ are the respective image focal points of the lenses 1 and 2, and the distance between $F_1'$ and $F_2'$ is C. Then, the composite focal length f' is expressed by $$f'=f_1'\times f_2'/(-C) \quad (1)$$

Generally, in the electron lens system, $C<0$, and hence $f'>0$. When the length l of the grid $G_4$, hence, the distance L between the lenses 1 and 2, is increased to diminish spherical aberration, the absolute value of C decreases and, as is obvious from Eq. (1), the composite focal length f' increases. Accordingly, significant increase of l and significant reduction of f for satisfactorily reducing spherical aberration as explained with reference to FIG. 10 are incompatible. Further, increase of f causes the focusing condition to change. Accordingly, to maintain f at a small value regardless of the increase of l, as is obvious from Eq. (1), the respective image focal lengths of the lenses 1 and 2 need to be decreased. However, since the variation of the distance Q between the after lens 2 and the fluorescent screen of the cathode-ray tube is limited by the relation of the after lens 2 to the horizontal and vertical deflecting means provided at the base of the funnel of the cathode-ray tube, and the reduction of the focal length $f_2'$ of the after lens 2 is limited to a certain extent. Therefore, it is desired to reduce the focal length $f_1'$ of the front lens 1. The focal length $f_1'$ of the front lens 1 can be reduced, for example, by increasing the ratio of the anode voltage $V_A$ applied to the grid $G_3$ to the focusing voltage $V_F$ applied to the grid $G_4$, namely, $V_A/V_F$. This method, however, requires an independent high-voltage circuit for applying a high voltage to the grid $G_3$ in addition to the circuit for the fifth grid $G_5$, which particularly is troublesome because the high-voltage circuit requires shielding.

To reduce the focal length $f_1'$ of the front lens system without encountering such problems, a front electron lens (lens 1) of a deceleration type is formed of a first electrode, i.e., the third grid $G_3$ and a second electrode, i.e., the fourth grid $G_4$, and an after electron lens (lens 2) of an acceleration type is formed of the second electrode (fourth grid $G_4$) and a third electrode, i.e., the fifth grid $G_5$ as shown in FIG. 12. In this arrangement, the length l of the grid $G_4$ is determined so that the respective electron lens regions of the front electron lens (lens 1) and the after electron lens (lens 2) are separated from each other, and the front electron lens (lens 1) and the after electron lens (lens 2) are designed so that the aperture of the front electron lens is smaller than that of the after electron lens. That is, the respective opposite ends of the third grid $G_3$ and the fourth grid $G_4$ are designed so that the aperture $D_1$ thereof is smaller than the aperture $D_2$ of the respective opposite ends of the fourth grid $G_4$ and the fifth grid $G_5$. That is, the grids are designed so as to comply with the inequality: $D_1/D_2=k<1$. To separate the respective electron lens regions of the front lens and the after lens from each other, the grids are designed so as to comply with the inequalities: $l_1>D_1$, $l_2>D_2$ and $l>D_1+D_2$, where $l_1$ is the length of the reduced section of the grid $G_4$, $l_2$ is the large section of the grid $G_4$, $D_1$ is the diameter of the reduced section of the grid $G_4$, and $D_2$ is the diameter of the large section of the grid $G_4$.

Suppose that the front electron lens and the after electron lens are the same in diameter, namely, $k=1$, so as to form an optical system as shown by continuous lines in FIG. 13, and the electron beams are focused on the fluorescent screen S of the cathode-ray tube. In FIG. 13, $P_0$ is an object point, namely, a cathode image formed at the cross-over point of the electron beams focused by a cathode prefocusing electron lens, $P_1$ is a virtual image formed by the front electron lens (lens 1), namely, the object point of the after lens (lens 2), and $P_2$ is an image focused on the fluorescent screen S by the after electron lens (lens 2). To reduce the focal length $f_1'$ of the front electron lens (lens 1) by decreasing the diamter $D_1$ without varying the focusing system, namely, to maintain the focusing system so that the image is focused on the fluorescent screen S, the front electron lens (lens 1) and the object point $P_0$ are shifted to positions indicated by broken lines, respectively. Optically, reducing the diamter of the front electron lens (lens 1) is equivalent to reducing the focusing system of the lens 1 without varying the magnification, because the respective magnifications of the lenses 1 and 2 are fixed. That is, the amount of aberration attributable to the lens 1 is expected to decrease according to the degree of reduction of the focusing system. More concretely, if the aperture $D_1$ of the front lens 1 is decreased, the distance between the lenses 1 and 2 is increased, and the cathodes K are shifted. Supposing that $M=12$, $Q=50\times D_2$, and $V_F/V_A$ is fixed, where M is the magnification of the lens system, and Q is the distance between the lens 2 and the image point $P_2$, O is the distance between the after lens 2 and the object point $P_O$, and L is the distance between the lenses 1 and 2, the variations of the distance O and L with the aperture ratio k are indicated by a continuous line and a broken line, respectively, in FIG. 14. In this case, the aperture $D_2$ of the after electron lens (lens 2) is 6 mm. In FIG. 14, the distances O and L are measured on the Y-axis by the aperture $D_2$ as a unit, namely, $D_2=1$.

FIG. 15 shows the calculated results of the relation between the coefficient of spherical aberration and $V_F/V_A$ for the aperture ratio, where $M=-8$ and $Q=50\times D_2$. In FIG. 15, curves 10, 11, 12 and 13 represent the variations of the coefficient Cs of spherical aberration with $V_F/V_A$ for $k=1.0$, 0.8, 0.6 and 0.4, respectively. Values in parentheses in FIG. 15 are the values of the distance L expressed by $D_2$ as the unit. In FIG. 15, the ratio $Cs/D_2$ is measured on the Y-axis.

FIG. 16 is similar to FIG. 15. In FIG. 16, $M=-10$, $Q=50\times D_2$, and curves 20, 21, 22, 23 and 24 are the variations of Cs with $V_F/V_A$ for k = 1.0, 0.8, 0.6, 0.4 and 0.3, respectively.

As is obvious from FIGS. 15 and 16, the smaller the aperture ratio k between the front and after electron lenses, namely, the smaller the aperture $D_1$ of the front electron lens relative to the aperture $D_2$ of the after electron lens, the greater is the improvement of aberration.

Thus, a lens system causing small spherical aberration is formed by forming an independent front lens region and an independent after lens region, and forming the front electron lens and the after electron lens so that the aperture ratio k therebetween is small. The coefficient Cs of the total spherical aberration of the composite lens system consisting of the lenses 1 and 2 formed by the front and after lens regions is expressed by $$Cs=k\cdot Cs^1+1/M_1^4\cdot(V_1/V_2)^{3/2}\cdot Cs^2 \quad (2)$$

where $Cs^1$ and $Cs^2$ are the coefficients of spherical aberration of the lenses 1 and 2, respectively.

Therefore, the amount of aberration r is $$\Delta r=M_1\cdot M_2\cdot\{k\cdot Cs^1(\phi_1)+1/M_1^4\cdot(\phi_1)^{3/2}\cdot Cs^2(\phi_2)\}\times(1/\phi_0)^{3/2}\cdot\alpha_0^3 \quad (3)$$

where k is the aperture ratio of the aperture $D_1$ of the front electron lens to the aperture $D_2$ of the after electron lens, $M_1$ and $M_2$ are the respective magnifications of the front and after electron lenses, $\phi_0=V_1/V_3$, $\phi_1=V_2/V_1$, $\phi_2=V_2/V_3$, and $V_1$, $V_2$ and $V_3$ are voltages applied to the first, second and third electrodes, respectively.

It is obvious from Equation (3) that reducing the aperture ratio k is effective for reducing the total aberration.

Thus, the aberration characteristics of the main electron lens consisting of the two independent lenses 1 and 2 can be improved by designing the lenses 1 and 2 so that the aperture ratio k is small, however, such a main electron lens is unsatisfactory with regard to astigmatism and the curvature of field. Accordingly, even if such a composite lens system is employed as a common main electron lens for a plurality of electron beams, for example, three electron beams as previously explained with reference to FIG. 6, and is designed so that the three beams $B_R$, $B_G$ and $B_B$ will intersect each other at a position to make coma aberration zero to meet the Fraunhofer conditions, the respective spots of the side beams $B_R$ and $B_B$ are liable to bloom.

Japanese Patent Provisional Publication No. 55-19755 discloses an electron gun arrangement intended to improve the condition of the spots of the side beams. In this known electron gun arrangement, a main electron lens comprises front electron lenses, namely, a front electron lens regions, and an after electron lens separate from the front electron lenses, namely, an after electron lens region. The front electron lenses, in particular, are individual electron lenses corresponding to the electron beams, respectively, while the after electron lens is a common electron lens for all the electron beams, having small characteristics of astigmatism and curvature of field. The aperture of each front electron lens is smaller than that of the after electron lens. In this electron gun arrangement, for example, the electrodes forming the front electron lenses of the main electron lens serve also as the electrodes of the cathode prefocusing electron lens, and hence the same focusing voltage is applied to those electrodes, whereby the cathode current is caused to vary by the dynamic focusing voltage, and the brightness of the fluorescent screen is caused to vary from position to position.

As illustrated in FIG. 17, this known electron gun arrangement has, for example, a main electron lens comprising front electron lenses of an decelerating bipotential electron lens system and an after electron lens of an accelerating bipotential electron lens system. Cathodes $K_R$, $K_G$ and $K_B$ for emitting, for example, electron beams $B_R$, $B_G$ and $B_B$ for red, green and blue, respectively, are provided and first grids $G_{1R}$, $G_{1G}$ and $G_{1B}$, second grids $G_{2R}$, $G_{2G}$ and $G_{2B}$, and third grids $G_{3R}$, $G_{3G}$ and $G_{3B}$ for the electron beams $B_R$, $B_G$ and $B_B$, respectively, are arranged sequentially. Fourth and fifth grids $G_4$ and $G_5$, namely, common grids, are arranged sequentially after the third grids. One end of the fourth grid $G_4$ facing the third grids $G_{3R}$, $G_{3G}$ and $G_{3B}$ is trifurcated in three cylindrical electrodes $G_{4R}$, $G_{4G}$ and $G_{4B}$, respectively, corresponding to the third grids $G_{3R}$, $G_{3G}$ and $G_{3B}$. Voltages according to an inequality $V_2<V_1<V_3$, where $V_1$ is a voltage applied to the third grids, $V_2$ is a voltage applied to the fourth grid and $V_3$ is a voltage applied to the fifth grid, are applied to the third, fourth and fifth grids, respectively. For example, the voltages $V_1$ and $V_3$ are equal to an anode voltage $V_H$. The electrodes $G_{4R}$, $G_{4G}$ and $G_{4B}$ of the fourth grid $G_4$ and the third grids $G_3$ constitute the decelerating bipotential front electron $Lens_{1R}$, $Lens_{1G}$ and $Lens_{1B}$ individually for the beams $B_R$, $B_G$ and $B_B$, respectively, of a main electron lens, while the fourth grid $G_4$ and the fifth grid $G_5$ constitute an accelerating bipotential after electron lens 2 commonly for the beams $B_R$, $B_G$ and $B_B$. The aperture ratio k of the aperture $D_1$ of the electrodes $G_{4R}$, $G_{4G}$ and $G_{4B}$ of the fourth grid $G_4$ to the aperture $D_2$ of the fourth grid $G_4$ at one end thereof facing the fifth grid $G_5$ is smaller than one, namely, $k=D_1/D_2<1$. The length of the fourth grid $G_4$ is greater than $D_1+D_2$ to separate the lens region of the after electron lens 2 from the lens region of the front $Lens_{1R}$, $Lens_{1G}$ and $Lens_{1B}$. The electron beams $B_R$, $B_G$ and $B_B$ are caused to intersect each other substantially at the center of the after electron lens 2 so as to meet the Fraunhofer conditions.

Referring to FIG. 18, showing another conventional electron gun arrangement, the after electron lens 2 of this electron gun arrangement is an extension type (extended field type) bipotential electron lens. The after electron lens 2 comprises fourth, fifth and sixth grids $G_4$, $G_5$ and $G_6$, and voltages $V_1$ to $V_4$ applied to the third grids $G_3$, the fourth grid $G_4$, fifth grid $G_5$ and the sixth grid $G_6$ meet, for example, the following conditions: $V_1=V_4$=anode voltage, $V_2/V_1=0.25$ to 0.40, and $V_3/V_4=0.4$ to 0.6.

The forming the main electron lens of the front electro lenses respectively for the electron beams, each having a small aperture, and the after electron lens commonly for all the electron beams, having a large aperture solves the problems of astigmatism of the front electron lenses and those of the curvature of field, and enables the employment of an electron lens having small astigmatism and the curvature of field as the after electron lens; consequently such a main electron lens of a multibeam single electron gun type is able to solve the blooming of the spots of the side beams attributable to astigmatism and the curvature of field.

FIG. 19 illustrates the electrode configuration of the foregoing electron gun arrangement. First grids $G_{1R}$, $G_{1G}$ and $G_{1B}$ are provided for cathodes $K_R$, $K_G$ and $K_B$, respectively, while second to sixth grids $G_2$ to $G_6$ are common grids. Thus, front lenses $Lens_{1R}$, $Lens_{1G}$ and $Lens_{1B}$ of a main electron lens are provided for electron beams emitted from the cathodes $K_R$, $K_G$ and $K_B$, respectively. The lenses $Lens_{1R}$, $Lens_{1G}$ *and* $Lens_{1B}$ are formed of electron beam transmission apertures $h_{3R}$, $h_{3G}$ and $h_{2B}$ formed in the front end plate of the common third grid $G_3$, and electron beam transmission apertures $h_{4R}$, $h_{4G}$ and $h_{4B}$ formed in the front end plate of the common fourth grid $G_4$, respectively. Similarly, to the foregoing front electron lenses, the front electron lenses $Lens_{1R}$, $Lens_{1G}$ and $Lens_{1B}$ are formed to meet the required relation described above. In forming the front electron lenses, the electron beam transmission apertures $h_{3R}$, $h_{3G}$ and $h_{3B}$ formed in the front end plate of the common third grid $G_3$ and the electron beam transmission apertures $h_{4R}$, $h_{4G}$ and $h_{4B}$ formed in the front end plate of the common fourth grid $G_4$ are formed with a press to form cylindrical walls Ws around the apertures, respectively, to prevent mutual disturbance in the respective electric fields. Electron beam transmission apertures are formed in the respective front end plates of the first grids $G_{1R}$, $G_{1G}$ and $G_{1B}$, the second grid $G_2$ and the third grid $G_3$ to form cathode prefocusing lenses respectively for the electron beams. The electron beam transmission apertures forming the cathode prefocusing lenses and the front electron lenses are coaxial with axes $O_R$, $O_G$ and $O_B$, which are in alignment with the electron beams, respectively. The axes $O_R$ and $O_B$ corresponding to the side beams are inclined at a predetermined angle $\theta$ to the axis $O_G$ corresponding to the center electron beam. Accordingly, the cylindrical walls Ws formed around the electron beam transmission apertures $h_{3R}$, $h_{3G}$ and $h_{3B}$ formed in the front end plate of the third grid $G_3$ and the electron beam transmission apertures $h_{4R}$, $h_{4G}$ and $h_{4B}$ formed in the rear end plate of the fourth grid $G_4$ should be formed coaxially with the axes $O_R$, $O_G$ and $O_B$, respectively, which requires complicated manufacturing processes and tends to cause problems during manufacturing accuracy such as maintaining the axes at accurate positions.

SUMMARY OF THE INVENTION

It is therefore an object of the present invention to solve the foregoing problems in the conventional electron gun arrangements and to provide an electron gun arrangement for emitting a plurality of electron beams, comprising a main electron lens having a plurality of front electron lens regions respectively formed for the electron beams and provided with electron beam transmission apertures formed with the respective center axes thereof parallel to each other, respectively, and an after electron lens region common to the plurality of electron bears which can be accurately manufactured using simple manufacturing processes.

It is another object of the present invention to provide an electron gun arrangement comprising a cathode prefocusing lens and a main electron lens having grids serving also as the grids of the cathode prefocusing lens, and capable of preventing variations of the cathode current caused by dynamic focusing currents applied to the grids.

It is a further object of the present invention to provide an electron gun arrangement having a center cathode emitting a center electron beam which is retracted away from a main electron lens relative to the side cathodes for emitting side electron beams, and which is capable of preventing distortion of an electric field which exerts a particular lens action on the center electron beam.

To achieve the objects of the invention, the present invention provides an electron gun arrangement comprising: a plurality of cathodes; a main electron lens having front electron lenses forming front electron lens regions each provided on the path of an electron beam emitted from the corresponding cathode, and a common after electron lens forming an after electron lens region separate from the front electron lens regions, provided in the respective paths of the electron beams; the aperture of the front electron lenses forming the front electron lens regions being smaller than the aperture of the after electron lens forming the after electron lens region; the respective center axes of the electron beam transmission apertures of electrodes forming the front electron lens regions on the paths of the electron beams, respectively, being parallel to each other; and each front electron lens region for each electron beam being formed so as to meet Fraunhofer conditions.

According to the present invention, although the front electron lenses are provided individually for the electron beams, respectively, the respective center axes of the electron beam transmission apertures of the front electron lenses are parallel to each other. Therefore, the electron beam transmission holes can be easily formed and with high accuracy and, even when circumferential walls are formed around the electron beam transmission apertures of the front electron lenses, the electron beam transmission apertures can be accurately formed relative to the intervals between the center axes thereof and the axial alignment. Furthermore, although the side electron beams travel at an angle to the respective optical axes of the corresponding front electron lenses, respectively, because the center axes of the front electron lenses are parallel to each other, aberration attributable to the differences between the paths of the electron beams and the axes of the corresponding front electron lenses is not a significant problem because the front electron lenses are formed so as to meet Fraunhofer conditions.

BRIEF DESCRIPTION OF THE DRAWINGS

The above and other objects, features and advantages of the present invention will become more apparent from the following description taken in conjunction with the accompanying drawings, in which.

DESCRIPTION OF THE PREFERRED EMBODIMENTS

Figure 1:
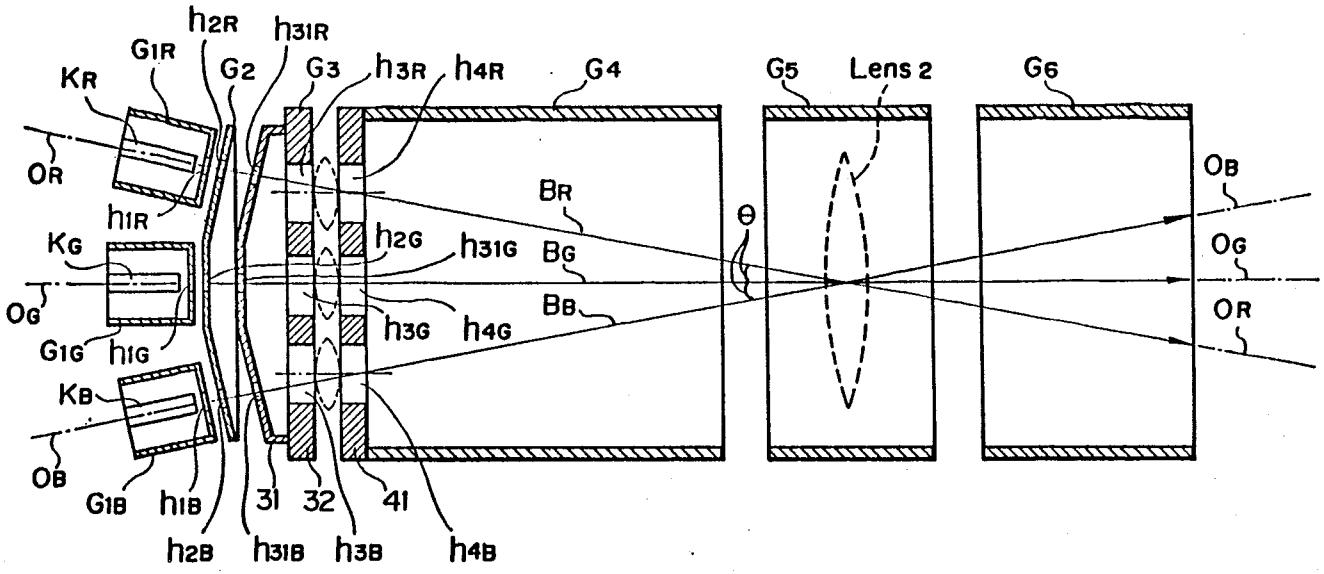
FIG. 1 is a longitudinal sectional view showing the electrode arrangement of an electron gun arrangement, in a preferred embodiment, according to the present invention.
Figure 2:
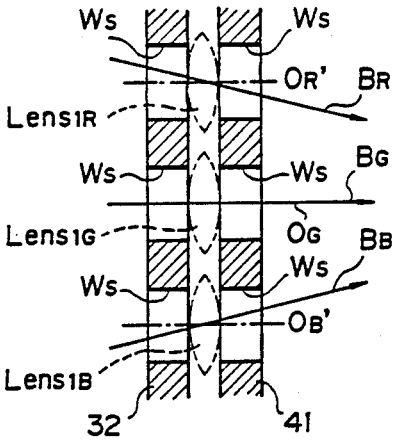
FIG. 2 is a fragmentary sectional view of an essential portion of the electron gun arrangement of FIG. 1.

A first embodiment of an electron gun arrangement of the present invention is shown in FIGS. 1 and 2. The electron gun arrangement employs a main electron lens of a unipotential type. Cathodes $K_R$, $K_G$ and $K_B$ for emitting electron beams, for example, for red, green and blue, respectively, are mounted as shown in FIG. 1. The center cathode $K_G$ is mounted with its center axis in alignment with the center axis $O_G$ of the electron gun arrangement, and the cathodes $K_R$ and $K_B$ are mounted on opposite sides of the cathode $K_G$ with their center axes inclined at an angle to the center axis $O_G$ of the electron gun arrangement. First grids $G_{1R}$, $G_{1G}$ and $G_{1B}$ are associated with the cathodes $K_R$, $K_G$ and $K_B$, respectively. The second grid $G_2$ through sixth grid $G_6$, which are common to all the electron beams $B_R$, $B_G$ and $B_B$, are arranged sequentially after the first grids $G_{1R}$, $G_{1G}$ and $G_{1B}$.

The third grid $G_3$ has a front end plate 31 which faces the second grid $G_2$ and has a rear end plate 32 which faces the fourth grid $G_4$. The fourth grid $G_4$ has a front end plate 41 which faces the third grid $G_3$.

The first grids $G_{1R}$, $G_{1G}$ and $G_{1B}$ are coaxial with the cathodes $K_R$, $K_G$ and $K_B$, respectively, and electron beam transmission apertures $h_{1R}$, $h_{1G}$ and $h_{1B}$ are formed coaxially with the cathodes $K_R$, $K_G$ and $K_B$ in the first grids $G_{1R}$, $G_{1G}$ and $G_{1B}$, respectively. Electron beam transmission apertures $h_{2R}$, $h_{2G}$ and $h_{2B}$, and electron beam transmission apertures $h_{31R}$, $h_{31G}$ and $h_{31B}$ are formed in the second grid $G_2$ and in the front end plate 31 of the third grid $G_3$ coaxially with the corresponding electron beam transmission apertures $h_{1R}$, $h_{1G}$ and $h_{1B}$, respectively. The electron transmission apertures of the first grids $G_1$, the second grid $G_2$ and the front end plate 31 of the third grid $G_3$ are formed so that the common center axis $O_R$ of the electron beam transmission apertures $h_{1R}$, $h_{2R}$ and $h_{31R}$ for the side electron beam $B_R$, and the common center axis $O_B$ of the electron beam transmission apertures $h_{1B}$, $h_{2B}$ and $h_{31B}$ for the side electron beam $B_B$ are inclined at a predetermined angle $\theta$ to the common center axis $O_G$ of the electron transmission apertures $h_{1G}$, $h_{2G}$ and $h_{31G}$ for the center electron beam $B_G$ and intersect each other at a predetermined point on the center axis $O_G$.

Electron beam transmission apertures $h_{3R}$, $h_{3G}$ and $h_{3B}$, and electron beam transmission apertures $h_{4R}$, $h_{4G}$ and $h_{4B}$ for transmitting the electron beams $B_R$, $B_G$ and $B_B$ are formed in the rear end plate 32 of the third grid $G_3$ and in the front end plate 41 of the fourth grid $G_4$, respectively.

Individual front electron lenses $Lens_{1R}$, $Lens_{1G}$ and $Lens_{1B}$ for the electron beams $B_R$, $B_G$ and $B_B$, respectively, of a main electron lens are formed between the corresponding electron beam transmission apertures of the third grid $G_3$ and the fourth grid $G_4$, respectively. The center axis of the electron beam transmission apertures $h_{3G}$ and $h_{4G}$ for the electron beam $B_G$ is aligned with the center axis $O_G$; the respective center axes $O_R'$ and $O_B'$ of the electron beam transmission apertures $h_{3R}$ and $h_{4R}$ for the side electron beam $B_R$, and the electron beam transmission apertures $h_{3B}$ and $h_{4B}$ for the side electron beam $B_B$ are parallel to the center axis $O_G$ and are symmetrical with respect to the center axis $O_G$ as shown in FIG. 2. That is, the center axes of the cathode prefocusing lenses for the side electron beams $B_R$ and $B_B$ are inclined at the predetermined angle $\theta$ to the center axis of the cathode prefocusing lens for the center electron beam $B_G$, and the axes of the front lenses $Lens_{1R}$, $Lens_{1G}$ and $Lens_{1B}$ of the main electron lens are parallel to each other.

Cylindrically shaped walls Ws are formed around the electron beam transmission apertures $h_{3R}$, $h_{3G}$ and $h_{3B}$ formed in the end plate 32 of the third grid $G_3$, and the electron beam transmission apertures $h_{4R}$, $h_{4G}$ and $h_{4B}$ formed in the end plate 41 of the fourth grid $G_4$, respectively, to isolate the lenses $Lens_{1R}$, $Lens_{1G}$ and $Lens_{1B}$ from each other. The cylindrically shaped walls Ws can be formed in the end plates 32 and 41, for example by forming the electron beam transmission apertures $h_{3R}$, $h_{3G}$, $h_{3B}$, $h_{4R}$, $h_{4G}$ and $h_{4B}$ in the end plates 32 and 41 which are each formed of a thick plate so that the thickness of the thick plate corresponds to the height of the cylindrically shaped walls, Ws, as shown in FIG. 2. If it is difficult to form the electron beam transmission apertures in the thick end plates 32 and 41 with high accuracy, the end plates 32 and 41 each may be a laminated plate formed by laminating a plurality of thin plates previously provided with holes that match each other using a laser laminating process.

Figure 3:
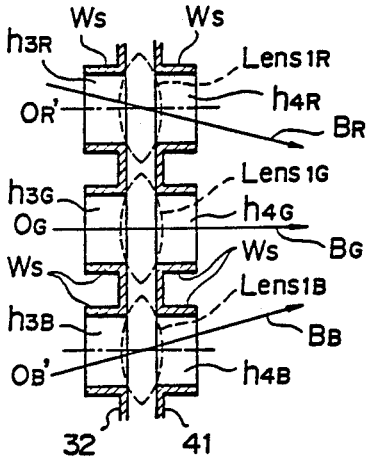
FIG. 3 is a fragmentary sectional view of a modification of the electron gun arrangement of FIG. 1.

It is also possible to form the cylindrical circumferential walls Ws by pressing the electron beam transmission apertures $h_{3R}$, $h_{3G}$ and $h_{3B}$, and the electron beam transmission apertures $h_{4R}$, $h_{4G}$ and $h_{4B}$ in the end plates 32 and 41 which are each formed of a comparatively thin plate as shown in FIG. 3.

Figure 4:
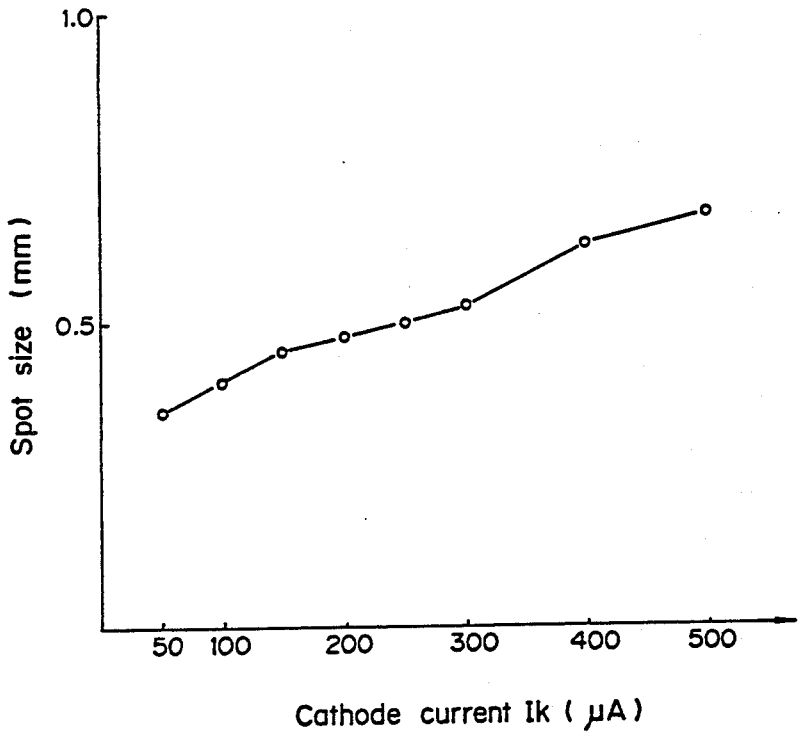
FIG. 4 is a graph showing the variation of spot size with cathode current in the electron gun arrangement according to the present invention.
Figure 5:
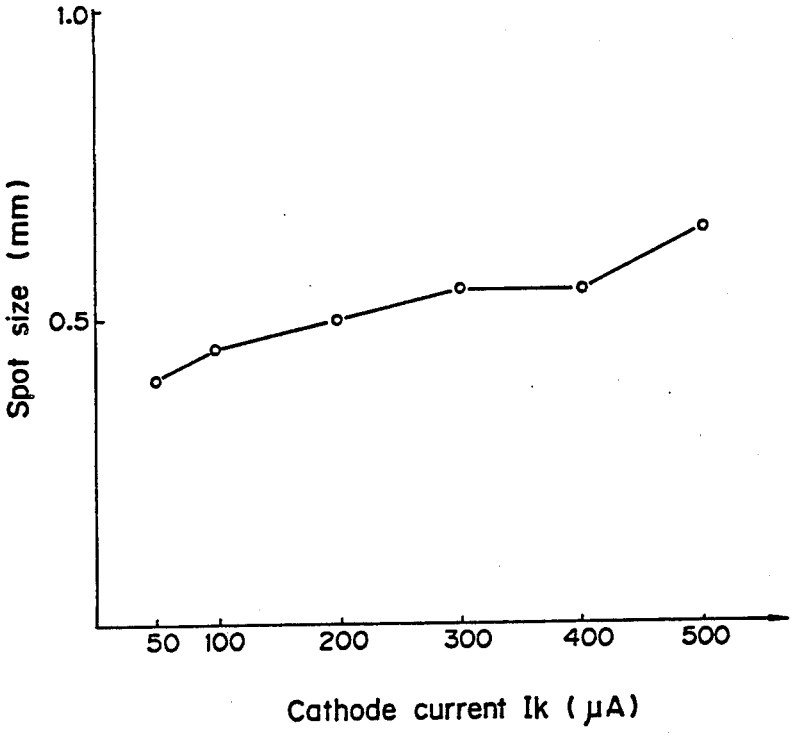
FIG. 5 is a graph showing the variation of spot size with cathode current in a conventional electron gun arrangement.
Figure 6:
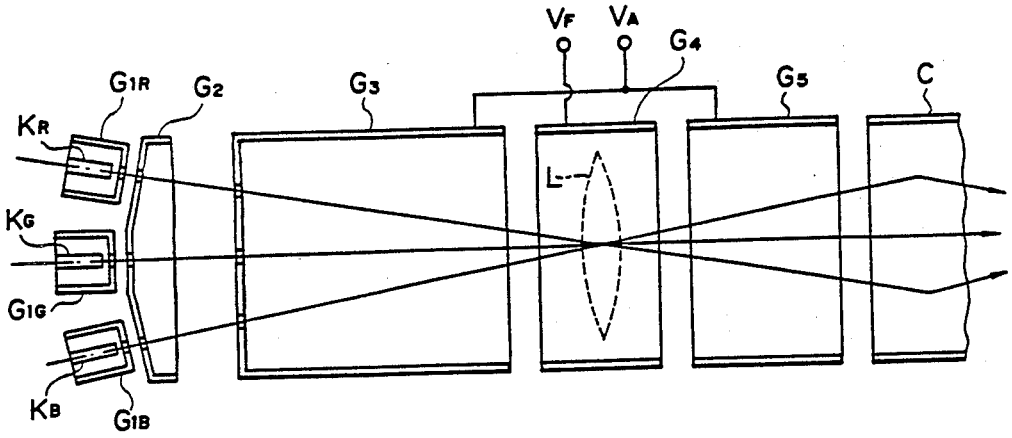
FIGS. 6 and 7 are a longitudinal sectional view and a fragmentary longitudinal sectional view of the electrode arrangement of a conventional electron gun arrangement, respectively.
Figure 19:
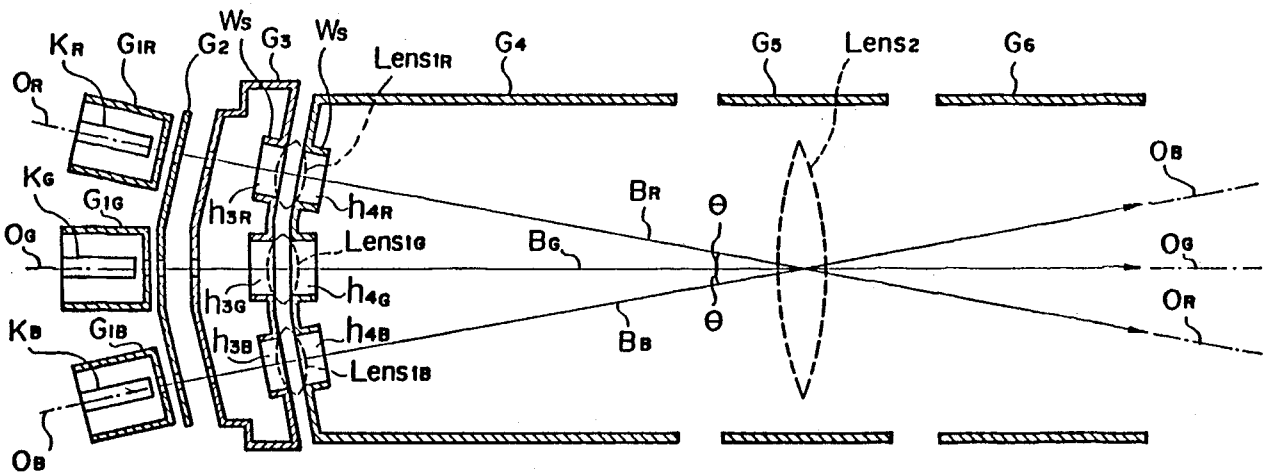
Figure 20:
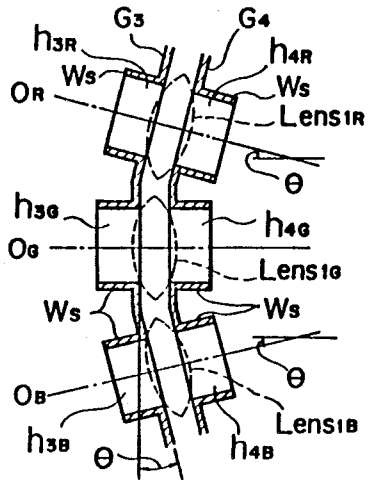

In the electron gun arrangement thus constructed, since the respective optical axes of the lenses $Lens_{1R}$, $Lens_{1G}$ and $Lens_{1B}$ are parallel to each other, the side electron beams $B_R$ and $B_B$ travel at a predetermined angle to the respective optical axes of the corresponding lenses $Lens_{1R}$ and $Lens_{1B}$. However, since the lenses $Lens_{1R}$ and $Lens_{1B}$ are formed at positions meeting Fraunhofer condition, namely, at positions where the coma aberration of the lenses is zero, respectively, the blooming of spots, for example, on the fluorescent screen of a color cathoderay tube due to the aberration of the electron beams $B_R$ and $B_B$ is prevented. FIG. 4 is a graph showing the measured results of the variation of spot size with cathode current Ik in the electron gun arrangement according to the present invention of the construction shown in FIGS. 1 and 2, and FIG. 5 is a graph similar to that of FIG. 4 for the conventional electron gun arrangement of the construction shown in FIG. 19. It is obvious from comparing FIGS. 4 and 5 that the electron gun arrangement of the present invention having lenses $Lens_{1R}'$ $Lens_{1G}$ and $Lens_{1B}$ arranged with their optical axes parallel to each other is superior to the conventional electron gun arrangement relative to spot size variation, because the electron gun arrangement of the present invention meets Fraunhofer conditions.

Figure 21:
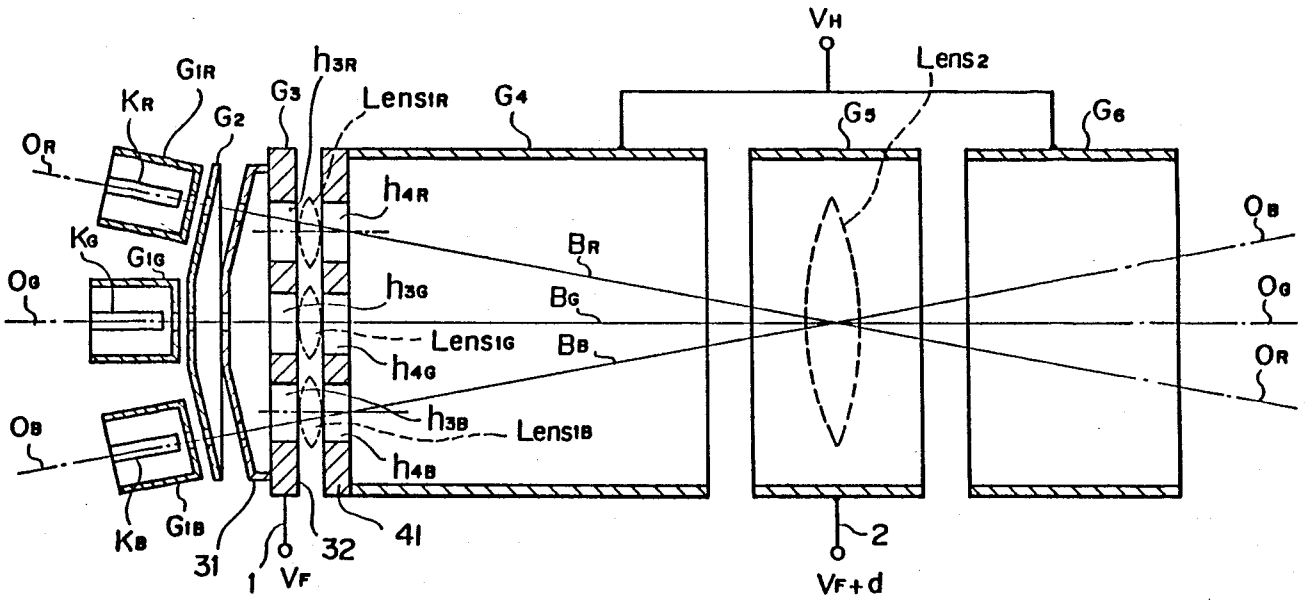
FIGS. 21 and 22 are sectional views showing the respective electrode arrangements of electron gun arrangements, in a second embodiment, according to the present invention.

FIG. 21 shows a second embodiment of an electron gun arrangement. Since the second embodiment is substantially the same as the first embodiment in its electrode arrangement, only those portions which are different from the first embodiment will be described in detail.

In the second embodiment, a high anode voltage $V_H$, for example, 27 kV, is applied to the fourth grid $G_4$ and the sixth grid $G_6$. The anode voltage is applied to the fourth grid $G_4$ and the sixth grid $G_6$ through a lead pin electrically interconnecting the fourth grid $G_4$ and the sixth grid $G_6$ which is connected to an internal conductive film formed over the inner surface of the cathode-ray tube and which is connected to an anode button, now shown provided in the funnel of the cathode-ray tube. Voltages $V_F$ and $V_F+d$ are applied individually to the third grid $G_3$ and the fifth grid $G_5$ through leads 1 and 2 connected to terminal pins, not shown, which penetrate a stem provided at the rear end of the cathode-ray tube, not shown. The prefocusing voltage $V_F$ applied to the third grid $G_3$ is a fixed voltage equal to, for example, 25 to 30% of the voltage $V_H$, as for example, 8 kV. A dynamic focusing voltage of a parabolic waveform varying, for example, in the range of 0 to +600V, in synchronism with the horizontal and vertical deflection of the electron beams is applied to the fifth grid $G_5$ in addition to the prefocusing voltage $V_F$. Voltages applied to the first grids $G_1$ ($G_{1R}$, $G_{1G}$, $G_{1B}$) and the second grid $G_2$ are, for example, on the order of 0 to several tens of volts and on the order of 600 to 700V, respectively.

The cathodes K ($K_R$, $K_G$, $K_B$), the first grids $G_1$ ($G_{1R}$, $G_{1G}$, $G_{1B}$), the second grid $G_2$ and the third grid $G_3$ constitute cathode prefocusing lenses, respectively, for the electron beams $B_R$, $B_G$ and $B_B$. The third grid $G_3$ and the fourth grid $G_4$ constitute the front electron lenses $Lens_{1R}$, $Lens_{1G}$ and $Lens_{1B}$ each having a small aperture of a main electron lens, while the fourth grid $G_4$, the fifth grid $G_5$ and the sixth grid $G_6$ constitute an after electron lens 2 of a unipotential type having a large aperture of the main electron lens. That is, the main electron lens comprises the front electron lenses $Lens_{1R}$, $Lens_{1B}$, and the after electron lens 2. A fixed focusing voltage is applied to the prefocusing electron lens of the main electron lens, i.e., the third grid $G_3$, while the dynamic focusing voltage d for correcting for variations of the distance between scanning positions on the fluorescent screen and the main electron lens is applied, in addition to the fixed prefocusing voltage, to the focusing electrode of the after electron lens, i.e., the fifth grid $G_5$.

Although in the second embodiment of the present invention comprises an electron gun arrangement comprising a main electron lens having front electron lenses each having an aperture smaller than that of the after electron lens of the main electron lens, the present invention is not limited thereto in its application and it is also applicable to various electron gun arrangements where some of a plurality of electrodes of a main electron lens to which focusing voltage is applied are associated with a cathode prefocusing electron lens.

Figure 22:
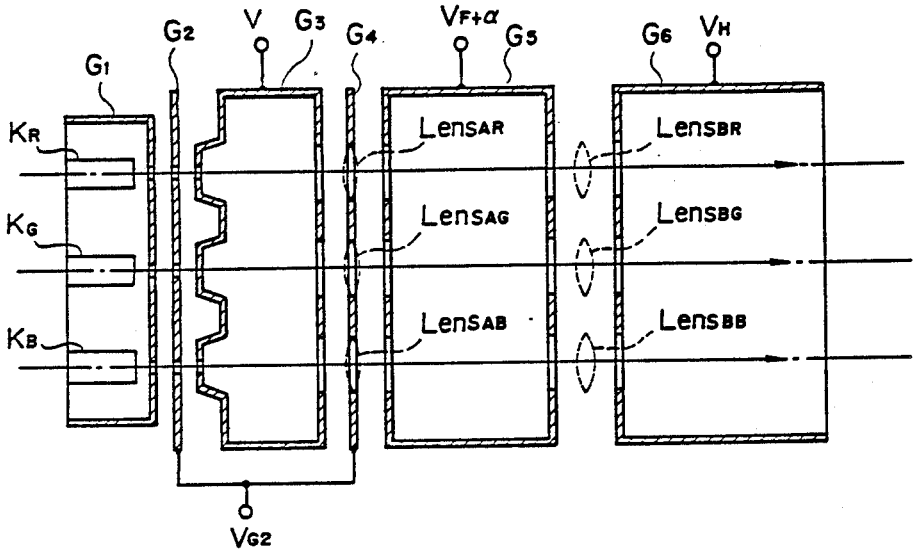

FIG. 22 shows an example of such an electron gun arrangement. The electron gun arrangement shown in FIG. 22 comprises three cathodes $K_R$, $K_G$ and $K_B$, and first to sixth grids $G_1$ to $G_6$ which are arranged sequentially and which are common to all the cathodes. The cathodes $K_R$, $K_G$ and $K_B$, and the first to third grids $G_1$ to $G_3$ form a cathode prefocusing electron lens, the third to fifth grids $G_3$ to $G_5$ form unipotential electron lenses $Lens_{AR}$, $Lens_{AG}$ and $Lens_{AB}$, and the fifth and sixth grids $G_5$ and $G_6$ form bipotential electron lenses $Lens_{BR}$, $Lens_{BG}$ and $Lens_{BB}$. The unipotential electron lenses and the bipotential electron lenses constitute a main electron lens. Ordinarily, a fixed low voltage is applied to the second grid $G_2$ and the fourth grid $G_4$, and a focusing voltage is applied to the third grid $G_3$ and the fifth grid $G_5$. According to the present invention, different voltages are applied to the third grid $G_3$ and the fifth grid $G_5$, respectively. That is, a fixed focusing voltage $V_F$ is applied to the third grid $G_3$, and a dynamic focusing voltage is applied to the fifth grid $G_5$ in addition to the focusing voltage $V_H$.

Figure 17:
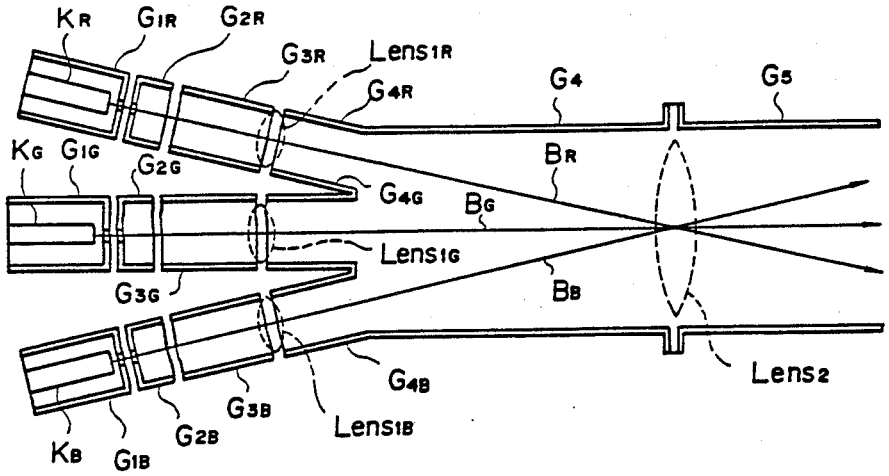
FIGS. 17 to 20 are sectional views showing the respective electrode arrangements of conventional electron gun arrangements.
Figure 18:
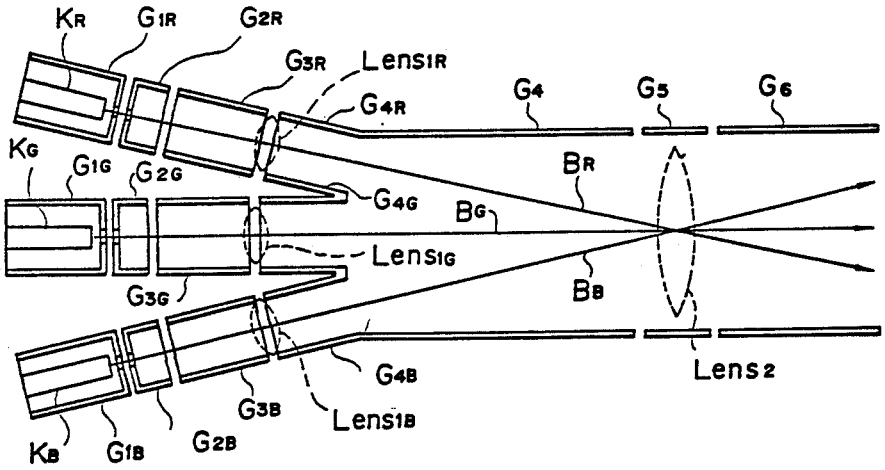

The first embodiment shown in FIG. 1 shows the present invention applied to an electron gun arrangement of a unipotential type corresponding to the electron gun arrangement shown in FIG. 18. The present invention is also applicable to electron gun arrangements of various types such as, for example, an electron gun arrangement of a bipotential type such as shown in FIG. 17 and an electron gun arrangement in which some of the electrodes of the main electron grids to which a focusing voltage is applied function also as the grids of a cathode prefocusing electron lens.

Figure 27:
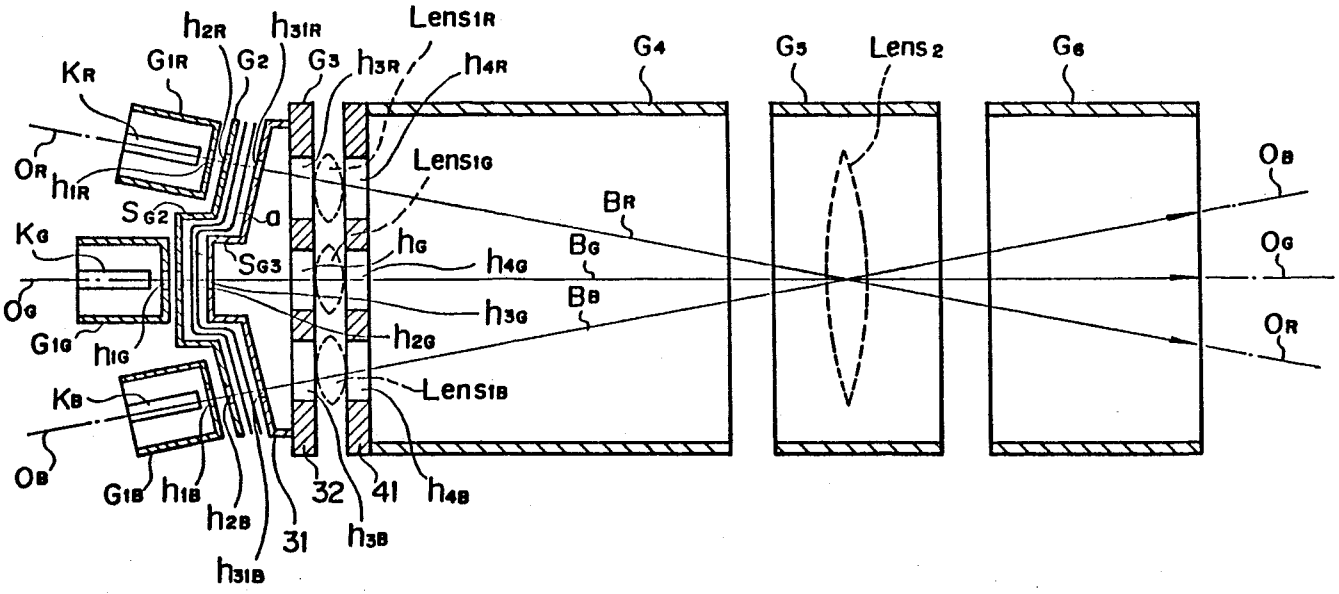
FIG. 27 is a longitudinal sectional view showing the electrode arrangement of an electron gun arrangement, in a third embodiment, according to the present invention.

FIG. 27 shows a third embodiment of the present invention. The third embodiment corresponds to the first embodiment shown in FIG. 1. In FIG. 27, those parts similar to those previously described with reference to FIG. 1 are marked with the same reference characters and the description thereof is omitted. In the third embodiment, a center cathode $K_G$ is positioned at a distance greater than the distance between the after electron lens 2 of a main electron lens and cathodes $K_R$ and $K_B$ from the after electron lens 2, namely, the center cathode $K_G$ is placed further away from the after electron lens 2 relative to the cathodes $K_R$ and $K_G$, and a first grid $G_{1G}$ corresponding to the cathode $K_G$ is moved away so that the respective distances between the cathodes $K_R$, $K_G$ and $K_B$ and the corresponding first grids $G_{1R}$, $G_{1G}$ and $G_{1B}$ are substantially the same.

Particularly, portions of the end plate of the second grid $G_2$ which are provided with electron beam transmitting apertures $h_{1R}$, $h_{1G}$ and $h_{1B}$ are formed in different flat planes, respectively so that the portions are positioned parallel to and substantially at the same distance from the corresponding first grids $G_{1R}$, $G_{1G}$ and $G_{1B}'$ respectively. So as to form the second grid $G_2$ in such a shape, the central portion of the second grid $G_2$ which provided with the electron beam transmitting aperture $h_{2G}$ is extended toward the first grid $G_{1G}$ by pressing to form a cylindrical portion $S_{G2}$ having a diameter greater than that of the first grid $G_{1G}$ and a bottom plane extending in parallel to the first grid $G_{1G}$. The central portion of the front end plate 31 of the third grid $G_3$ which is provided with the electron beam transmitting aperture $h_{31G}$ is extended toward the second grid $G_2$ by pressing to form a cylindrical portion $S_{G3}$ having a diameter smaller than that of the cylindrical portion $S_{G2}$. The third grid $G_3$ is disposed so that the bottom wall of the cylindrical portion $S_{G3}$ extends parallel to the bottom portion $S_{G2}$ of the second grid $G_2$.

Figure 7:
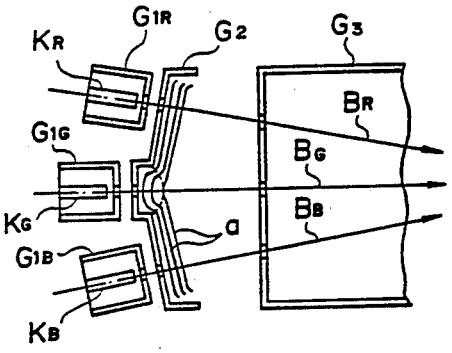
Figure 8:
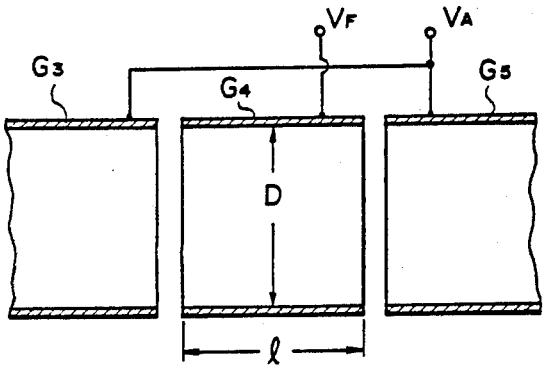
FIGS. 8, 9, 11 and 12 are schematic sectional views of electron gun arrangements used for explaining the construction and performance of the electron gun arrangements.
Figure 9:
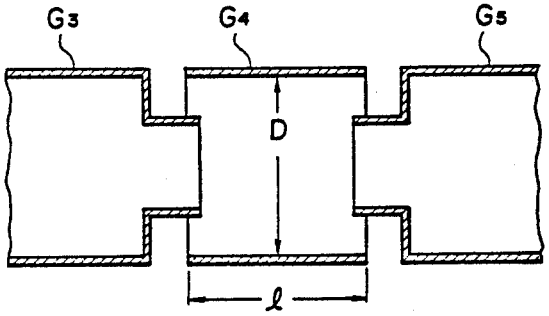
Figure 10:
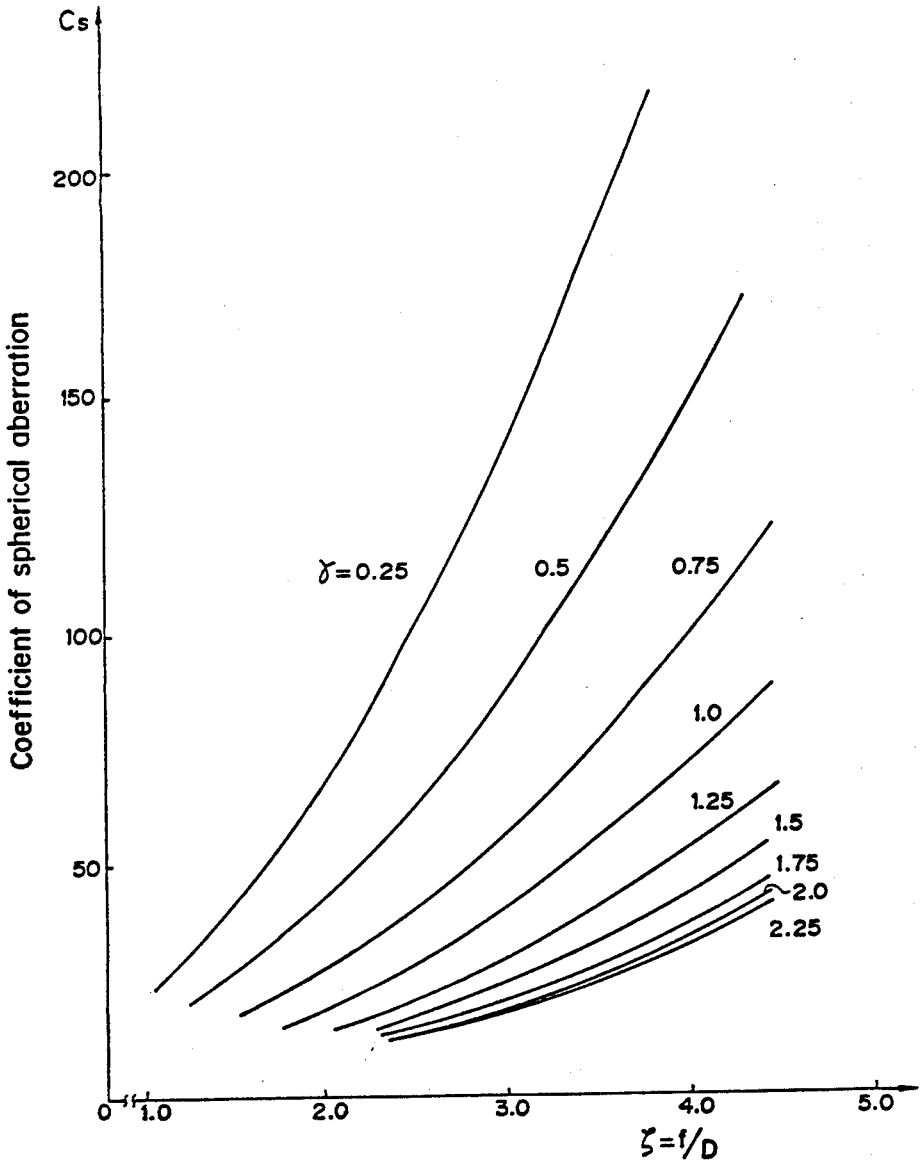
FIG. 10 is a graph showing the variation of spherical aberration with the ratio of focal length to lens aperture for the ratio of length to diameter of the electron lens.
Figure 11:
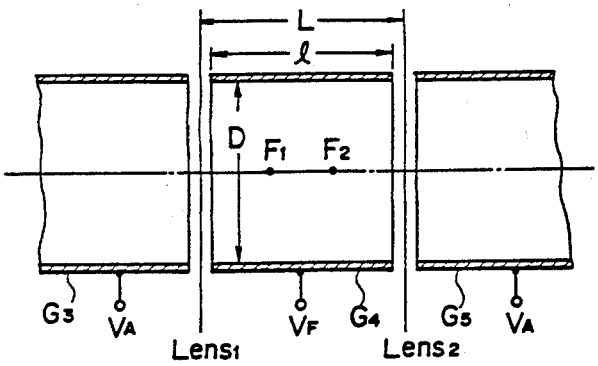
Figure 12:
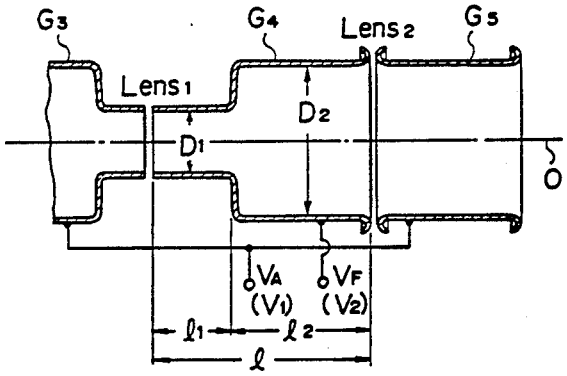
Figure 13:
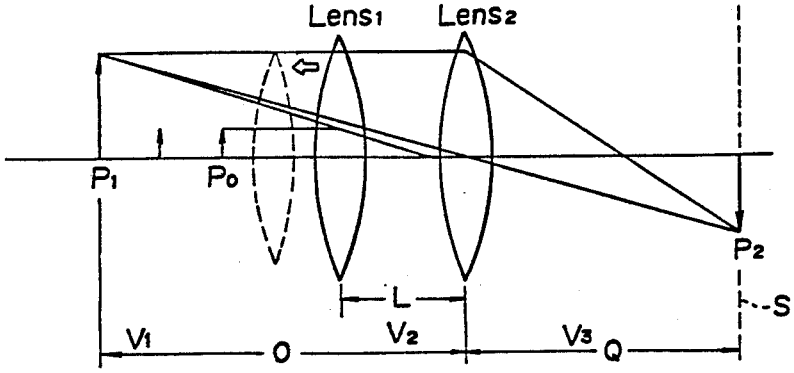
FIG. 13 is a diagrammatic illustration used for explaining the characteristics of the electron lens.
Figure 14:
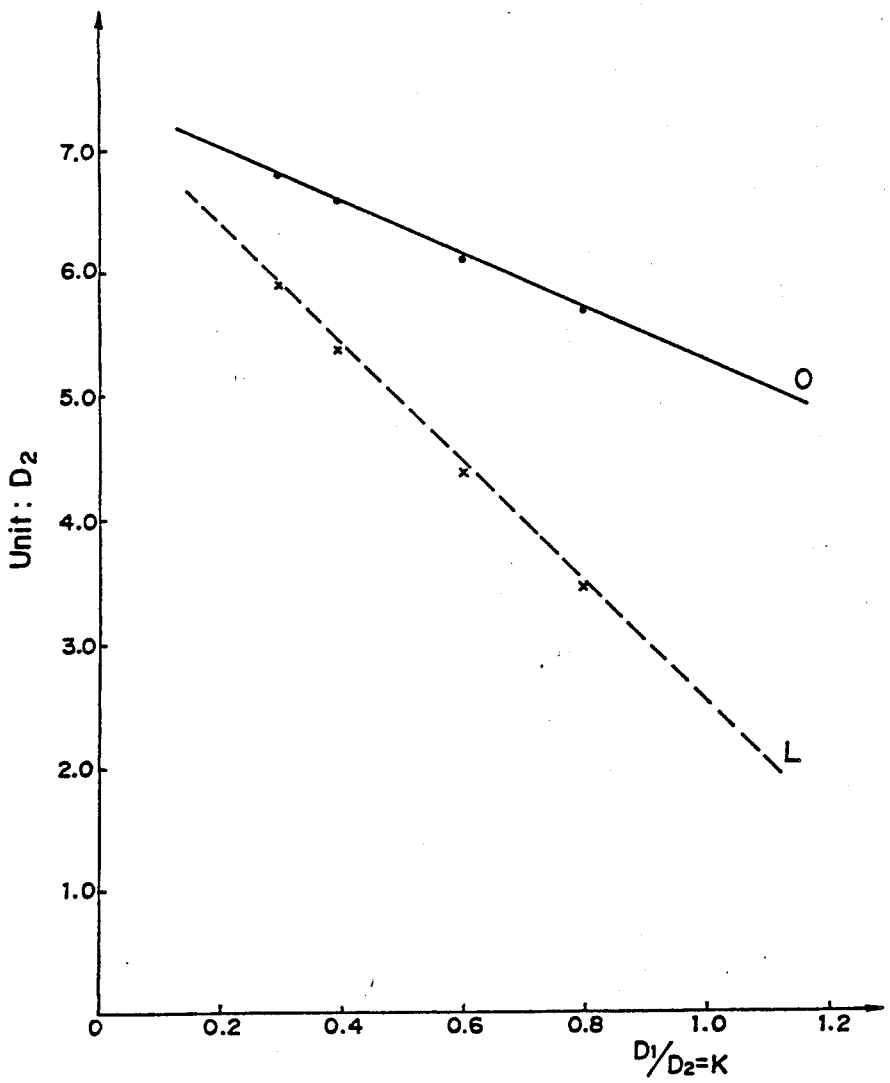
FIG. 14 is a graph showing the respective variations of the distance between a front electron lens and an after electron lens, and the object distance with the aperture ratio of the front electron lens to the after electron lens.
Figure 15:
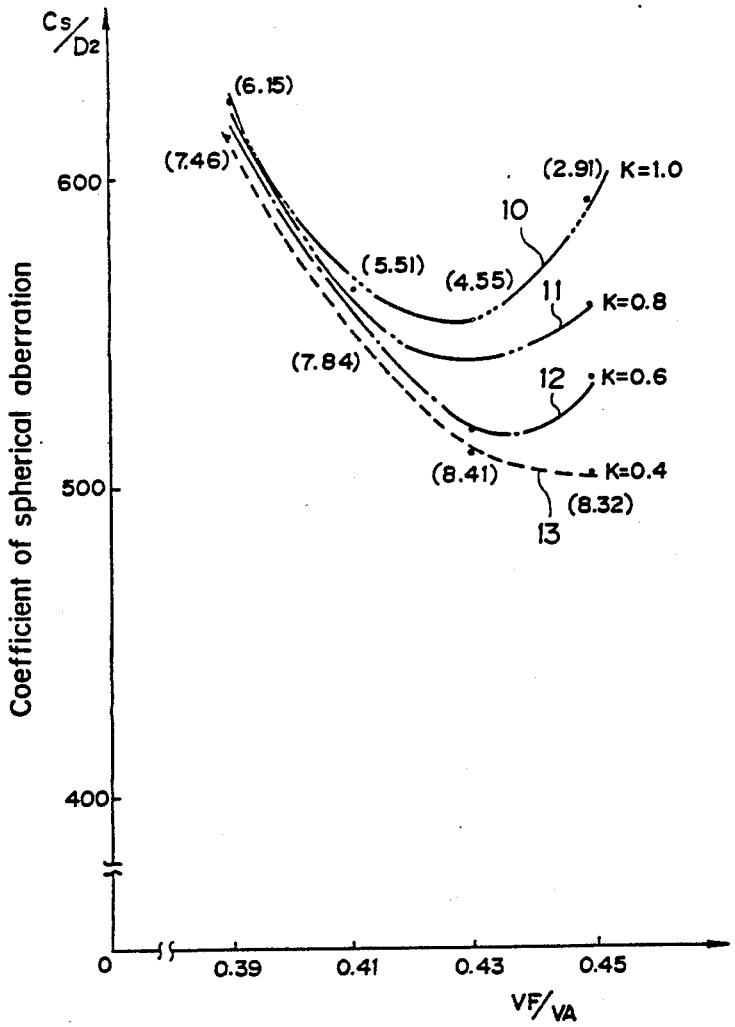
FIGS. 15 and 16 are graphs showing the variations of the coefficient of spherical aberration with the ratio of focusing voltage to anode voltage.
Figure 16:
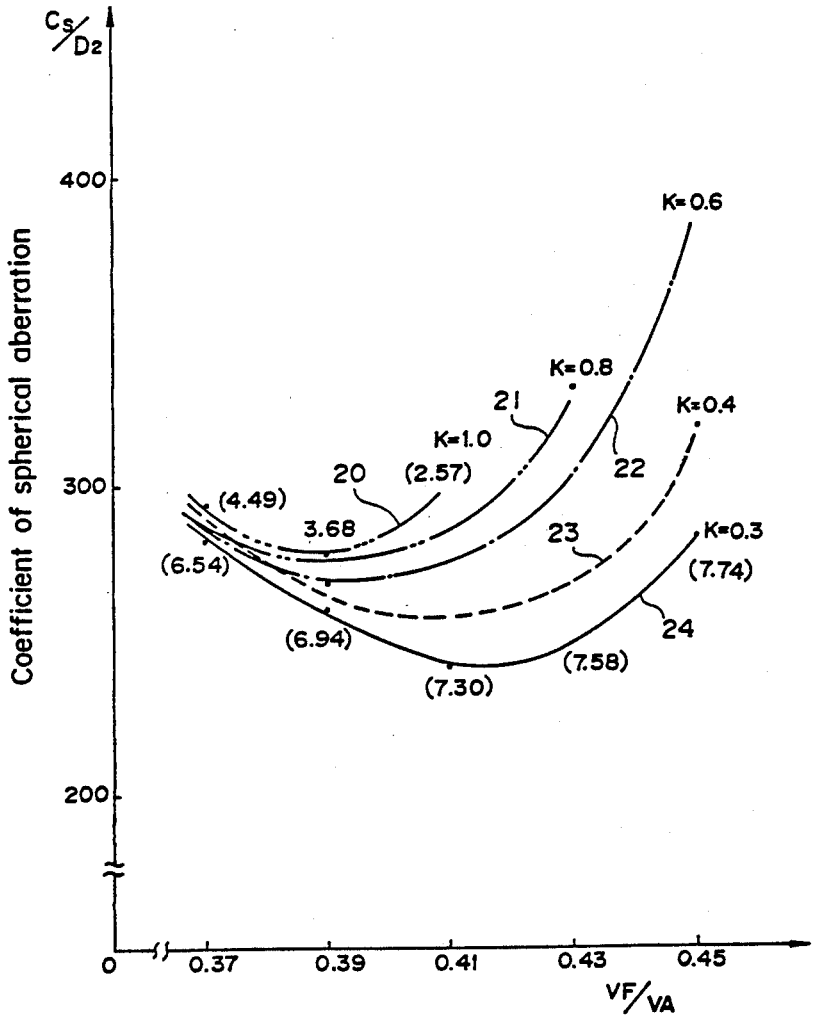

Thus, the respective distances of the first grids $G_1$ from the corresponding cathodes K are the same, the respective distances of the second grids $G_2$ from the corresponding first grids $G_1$ are the same, and the respective distances of the third grids $G_3$ from the corresponding second grids $G_2$ are the same, so that all the electron beams are subjected to the same effect from the cathode prefocusing lens and the equipotential surface between the second grid $G_{2G}$ and the third grid $G_{3G}$ for the center electron beam $B_G$ is formed in a flat plane and is not distorted into a curved surface as shown in FIG. 7 so as to exert an undesirable lens effect on the center electron beam $B_G$.

Since the central portion of the front end plate 31 of the third grid $G_3$ extends backwardly to form the cylindrical portion $S_{G3}$, the distance between the cylindrical portion $S_{G3}$ and the rear end plate 32 is greater than those between the portions of the front end plate 31 for the side electron beams and the rear end plate 32. However, no irregular electric field which would exert undesirable lens actions on the electron beams are not formed because the end plates 31 and 32 are integral parts of the third grid $G_3$.

The after electron lens of a unipotential type of the main electron lens employed in the foregoing embodiments may be substituted for an electron lens of an extended field unipotential type.

As is apparent from the foregoing description, according to the present invention, the main electron lens of an electron gun arrangement comprises a front electron lenses and an after electron lens, which are formed separately, and the front electron lenses are formed with an aperture smaller than that of the after electron lens to reduce aberration, and the front electron lenses are formed with the respective optical axes thereof parallel to each other without causing an increase in aberration. Therefore, the electron gun arrangement can be easily manufactured, the axes of the electron lenses can be accurately maintained during machining, and the electron gun arrangement can be manufactured precisely in conformity to design conditions.

Furthermore, according to the present invention, the center cathode is extended backwardly relative to the other cathodes so as to subject all of the electron beams to the same effect of the focusing voltage and, particularly, a low voltage is applied to the third grid of the electron gun arrangement so that the grids forming the cathode prefocusing electron lens can be mounted close to each other so that all of the electron beams are subjected to the same effect of the electric field, and thus undesirable lens effects are avoided.

Also, as mentioned above with reference to the embodiments of the present invention, since a fixed focusing voltage is applied to the electrodes of the main electron lens, also serving as the components of the prefocusing electron lens, while a dynamic focusing voltage for correcting the variation of the focus attributable to the variation of the distance between the main electron lens and a scanning position on the fluorescent screen is applied, in addition to the fixed focusing voltage, to the focusing electrodes associated only with the main electron lens, brightness irregularity on the fluorescent screen of the cathode-ray tube attributable to the effect of the dynamic focusing voltage on the cathode focusing electron lens is prevented.

Figure 23:
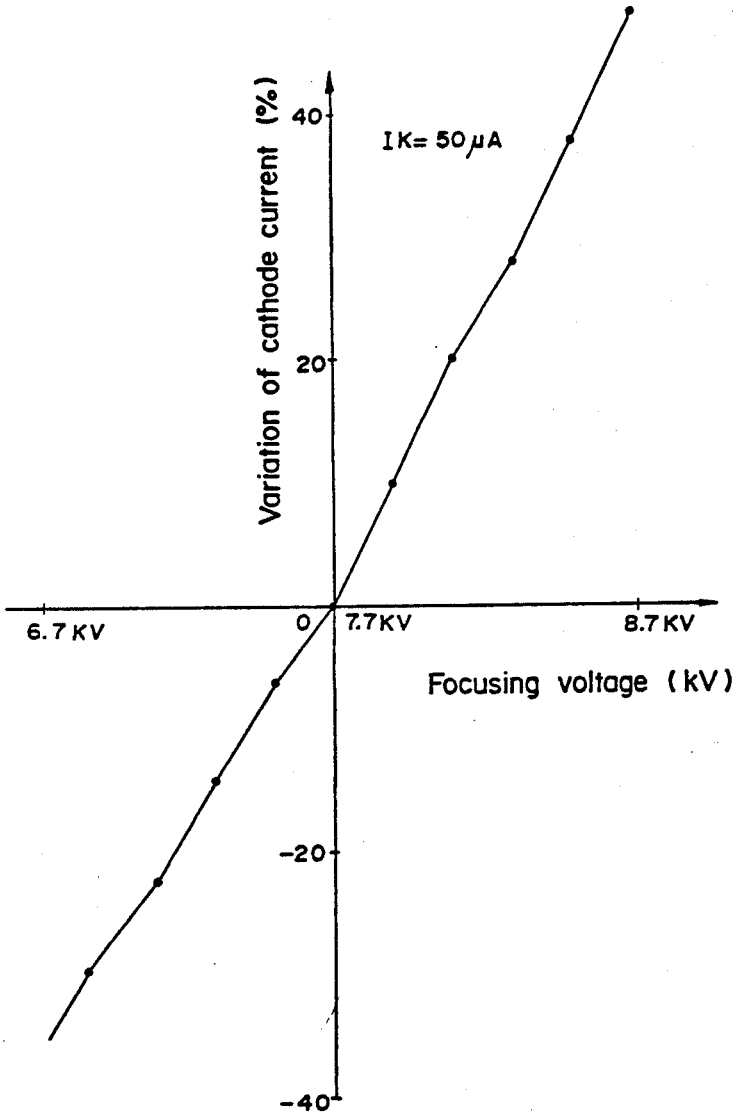
FIGS. 23 to 26 are empirical graphs showing the variations of cathode current with focusing voltage.
Figure 24:
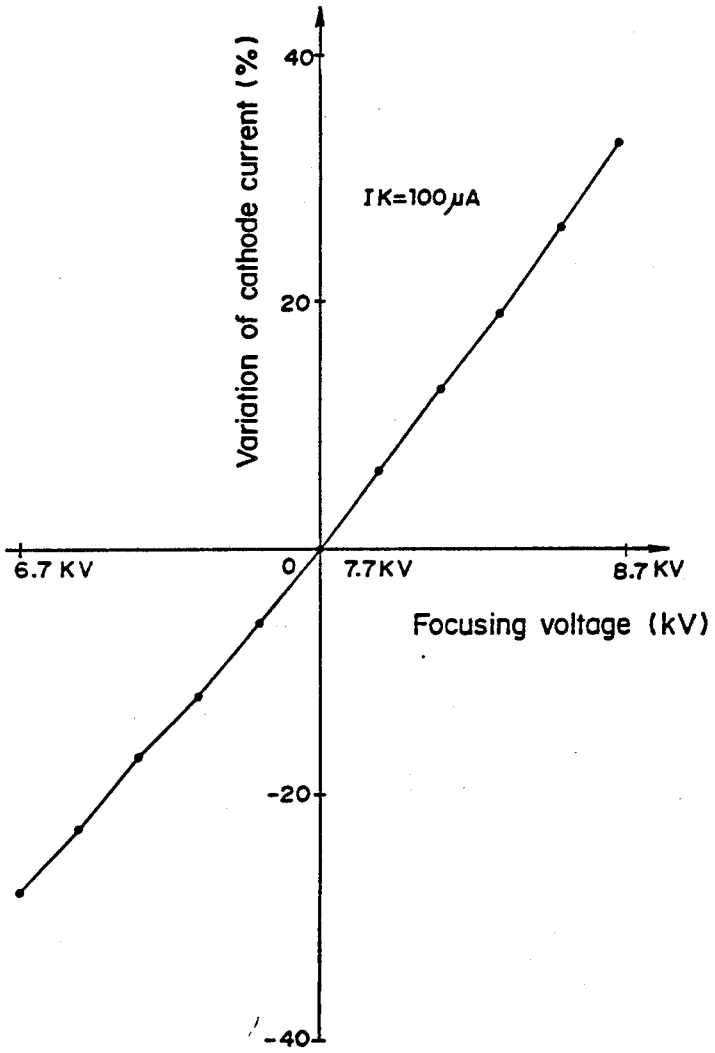
Figure 25:
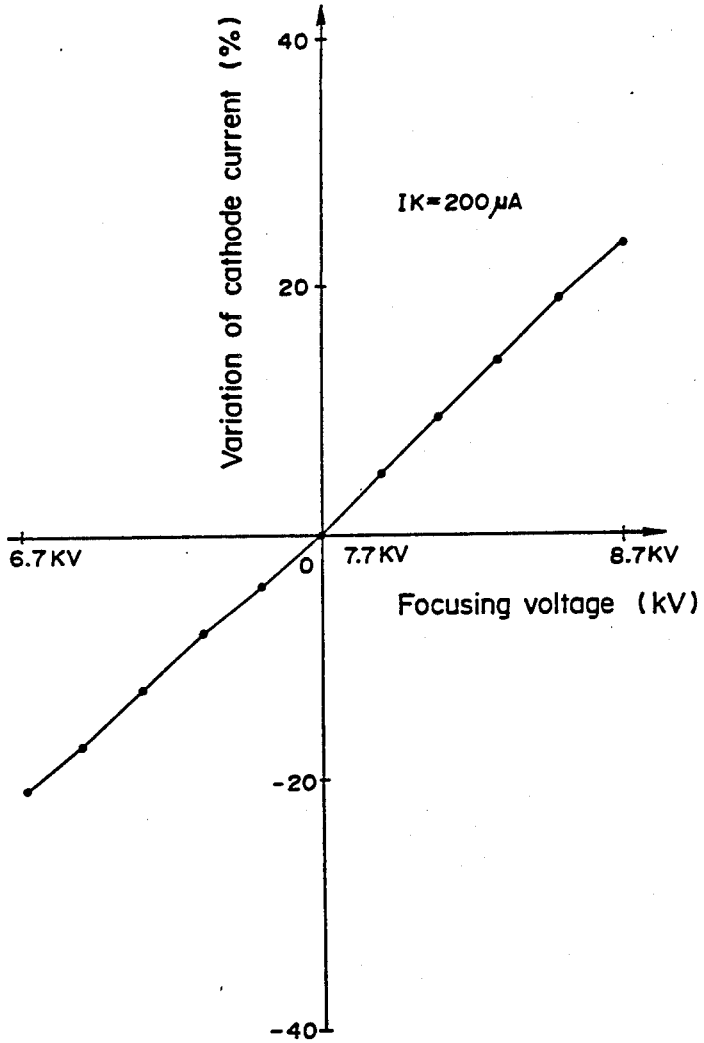
Figure 26:
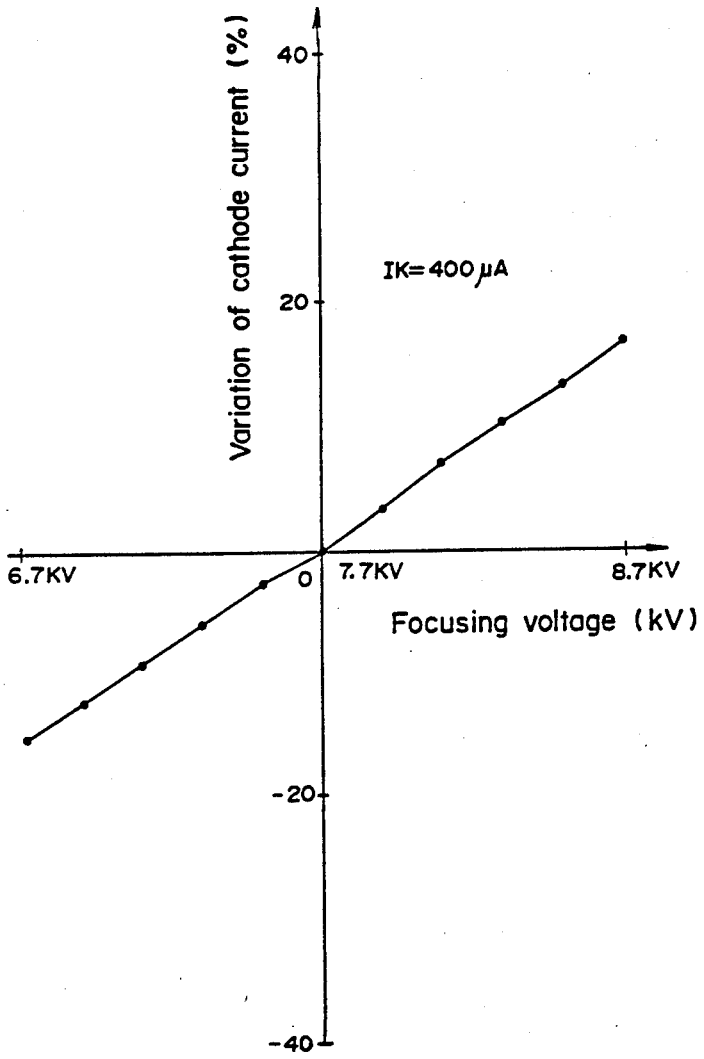

FIGS. 23 to 26 are graphs showing the experimental results of cathode current variations with the focusing voltage $V_F$ when the same focusing voltage $V_F$ is applied to the third grid $G_3$ and fifth grid $G_5$ of the electron gun arrangement shown in FIG. 21. In the experiments, the voltage applied to the second grid $G_2$ was regulated so that the cathode cutoff voltage E KCO was +100V when the focusing voltage $V_F$=7.7 kV which focuses the electron beams precisely at the center of the fluorescent screen, the cathode voltage was adjusted to voltages to make the cathode current Ik 50, 100, 200 and 400 μA, and the focusing voltage was varied in the range of 6.7 to 8.7 kV. It is obvious from FIGS. 23 to 26 that the variations of the cathode current Ik is dependent on the focusing voltage and, as best shown in FIG. 23, the smaller the cathode current Ik, the greater is the variation of the cathode current Ik.

Although the invention has been described in its preferred forms, it is to be understood to those skilled in the art that many changes and variations are possible in the invention without departing from the scope and spirit as defined by the appended claims.

We claim as our invention:

1. An electron gun for a multigun cathode ray tube comprising, three cathodes mounted side by side so as to define a center cathode and two side cathodes, three first electrodes which are generally cylindrical-shaped and are formed with beam emitting apertures mounted so as to respectively, surround said three cathodes, a second electrode formed with three beam apertures mounted adjacent said three first electrodes, a third electrode mounted adjacent said said electrode and having a first portion adjacent said second electrode formed with a center and two side beam apertures and said first portion being curved so that its beam apertures do not lie in the same plane and having a second portion spaced from said first portion add formed with a center and two side beam apertures which are larger than said beam apertures in said first portion and the outer edges of said first and second portions connected together to form an enclosed space and the distance between the center beam apertures in said first and second portions being greater than the distances between said side beam apertures, a fourth electrode mounted adjacent said third electrode and having a planar portion with three beam apertures and a tubular portion attached to said planar portion, a fifth tubular shaped electrode of large diameter adjacent said fourth electrode, a sixth tubular shaped electrode mounted adjacent said fifth electrode, means for applying fixed focusing voltages to said first, second, third, fourth and sixth electrodes, and means for applying a dynamic voltage to said fifth electrode.

2. An electron gun according to claim 1 wherein said second portion of said third electrode is planar and said center cathode is spaced further from said second portion of said third electrode than said two side cathodes.

3. An electron gun according to claim 2 wherein said three first electrodes comprise a center first electrode and two outer first electrodes which are mounted so that they are not parallel to said center first electrode.

* * * * *